US006714854B2

(12) United States Patent
Linenberg et al.

(10) Patent No.: US 6,714,854 B2
(45) Date of Patent: Mar. 30, 2004

(54) METHOD OF COMPENSATING FOR THE EFFECTS OF USING A BLOCK HEATER IN AN INTERNAL COMBUSTION ENGINE

(75) Inventors: Mark Thomas Linenberg, Dearborn, MI (US); John William Holmes, Eastpointe, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 77 days.

(21) Appl. No.: 10/064,910

(22) Filed: Aug. 28, 2002

(65) Prior Publication Data

US 2004/0044462 A1 Mar. 4, 2004

(51) Int. Cl.[7] ..... G01M 15/00; F02D 41/06

(52) U.S. Cl. ..... 701/113; 701/102; 73/118.1; 123/41.15; 123/549

(58) Field of Search ..... 701/113, 102, 701/101, 35, 29; 73/117.3, 118.1; 123/41.15, 543, 549, 491

(56) References Cited

U.S. PATENT DOCUMENTS 4,177,925 A * 12/1979 Ashling ..... 123/41.09
5,781,877 A 7/1998 Rachel et al.
5,884,243 A 3/1999 Taniguchi et al.
6,283,381 B1 * 9/2001 Uchiyama ..... 123/41.15
6,393,357 B1 * 5/2002 Holmes et al. ..... 701/102

FOREIGN PATENT DOCUMENTS

JP 2002-30959 * 1/2002 ..... F02D/41/06
JP 2003-227379 * 8/2003 ..... F02D/41/06

* cited by examiner

*Primary Examiner*—Hieu T. Vo

(57) ABSTRACT

A method for determining the use of a block heater in an internal combustion engine and compensating for the effects that such heaters can have on an engine coolant sensor. The method uses measurements of ambient air temperature to determine if the use of a heater is likely and then compares the measured coolant temperature with an inferred coolant temperature to verify the usage of the block heater when the difference is significant. When use of a heater is detected, the value for coolant temperature initially supplied to the engine control system is compensated with a normalized coolant temperature value that is based on a functional relationship between the inferred engine temperature and the measured coolant temperature. Then as the mechanism of the engine begins to mechanically turn and the coolant is circulated, the normalized value of coolant temperature is filtered in a way that the normalized value approaches the temperature reading from the coolant sensor, as the starting process continues.

17 Claims, 2 Drawing Sheets

METHOD OF COMPENSATING FOR THE EFFECTS OF USING A BLOCK HEATER IN AN INTERNAL COMBUSTION ENGINE

BACKGROUND OF INVENTION

1. Field of the Invention

The present invention relates to the field of internal combustion engine control and more specifically to a system for detecting the use of a block heater device and providing a modified variable for such control.

2. Disclosure Information

In cold climates, block heater devices are often used to heat the coolant fluid in the blocks of internal combustion engines. Such heaters are well known and are useful in lowering the viscosity of oil and coolant fluids while engines are turned off, in order to reduce the power requirements necessary to start the engines in extremely cold conditions.

When a block heater is in use, the distribution of heat throughout the coolant is uneven and the temperatures vary widely during the time the engine is not operating. A problem identified in the use of block heaters is that an engine coolant temperature sensor (ECT), because of its close proximity to the block heater element and the non-circulating but heated coolant, can provide a higher temperature reading at initial cold start-up than the actual average or distributed temperature of the coolant. When this occurs, the engine control system receives false or inaccurate information and may provide a leaner air/fuel mixture than the engine can effectively use to achieve a start. The problem may persist for approximately the first half-minute following the commencement of the start cycle, until the coolant is pumped and circulated within the engine block and the sensor reads the proper temperature of the coolant.

The problem of inaccurate coolant temperature readings during the cold start cycle, due to the usage of an engine block heater, is recognized in commonly assigned U.S. Pat. No. 5,781,877 to Rachel, et al, which is hereby incorporated by reference into this application.

In U.S. Pat. No. 5,781,877, the solution involves the use of component sensors that are already part of the engine control system, including an ambient air temperature sensor, a heated exhaust gas oxygen sensor (HEGO) and an engine coolant temperature sensor. If the temperature measurements at start up for each of the three sensors are below predetermined levels, indicating extremely low temperatures, a determination is made that there is a possibility that a block heater is in use. Once that determination is made, the disclosed method calculates a delta temperature value that serves to offset and lower the value provided by the engine coolant sensor to the engine control system. The modified temperature value is then used by the engine control system as a substitute for the output of the engine coolant sensor in providing calculations of proper component levels of air/fuel mixture. The use of the calculated delta offset continues until the HEGO sensor reaches a predetermined level to indicate that the engine has started and is running, or until the coolant temperature reaches a predetermined level.

SUMMARY OF INVENTION

The present invention has the advantage of relying on the output of only two sensors and therefore performing fewer steps in the process than the prior art. In addition, the process for compensating for the effects of the block heater usage on the engine coolant temperature sensor provides a highly accurate and changing normalized value of coolant temperature variable to the engine control system.

The process is performed following a key-on start command, by initially measuring the ambient air temperature to determine whether the air is cold enough to make a difference in the start sequence of the engine control system. If the air temperature is indeed below a defined extreme cold threshold value, the process continues and calculates the difference between the sensed engine coolant temperature and an inferred engine coolant temperature. If the difference is greater than a predetermined amount, it is determined that the output of the engine coolant temperature sensor has been effected enough by the heater to adversely influence the calculations of the engine control system as it attempts to provide the proper air/fuel mixture for starting the engine in extreme cold. A normalized engine coolant temperature value is then determined and that value is initially provided to the engine control system as a substitute for the temperature value output by the engine coolant temperature sensor. As the engine is then cranked and begins to operate the water/coolant pump to circulate the coolant fluid within the engine block, the normalized engine coolant temperature value is recalculated with each cycle of the program and filtered in a way that it approaches the actual value provided by the engine coolant temperature sensor within the first half minute during a continuous start process.

The present invention has been optimized to account for the gradual transition in engine coolant temperature from a non-uniform distribution to a more uniform distribution as the engine begins turning and the engine coolant is circulated and mixed. The method is also designed to correctly account for repeated key-on and key-off cycling, restarts after stalls, short engine soaks or short engine running periods. Such enhancements provide for much improved engine start and run fuel delivery during all block heater assisted starts.

It is therefore an object of the present invention to provide an enhancement to an engine control system that overcomes the effects of inaccurate coolant temperature readings when a block heater is being used in cold weather conditions.

It is another object of the present invention to provide a highly accurate compensation to the inaccurate coolant temperature sensor reading until there is sufficient coolant circulation in the engine to allow the system to rely on the sensor's readings.

These advantages and objects of the present invention, as well as others, will be readily apparent from the following detailed description of the best mode for carrying out the invention when taken in connection with the accompanying drawings.

DETAILED DESCRIPTION

As will be appreciated by those skilled in the art, the present invention is independent of any particular engine technology and may be used in a variety of types of internal combustion engines which use engine coolant temperature values for informational, diagnostic, and/or control purposes. For example, the present invention may be used in conventional gasoline and diesel engines, as well as direct injection stratified charge (DISC) or direct injection spark ignition (DISI) engines, which may use VCT or variable valve timing mechanisms.

It is also understood that while the present invention is implemented by use of a programmed microprocessor, it could also use logic elements or other techniques that have equivalent effect. While no drawings are included to show the relative locations of engine components and sensors and control systems, such background information is well known to those skilled in the art. Applicants rely on the specification and drawings found in U.S. Pat. No. 5,781,877, which has been incorporated herein by reference, for such background and other essential information that supports the present invention.

Figure 1:
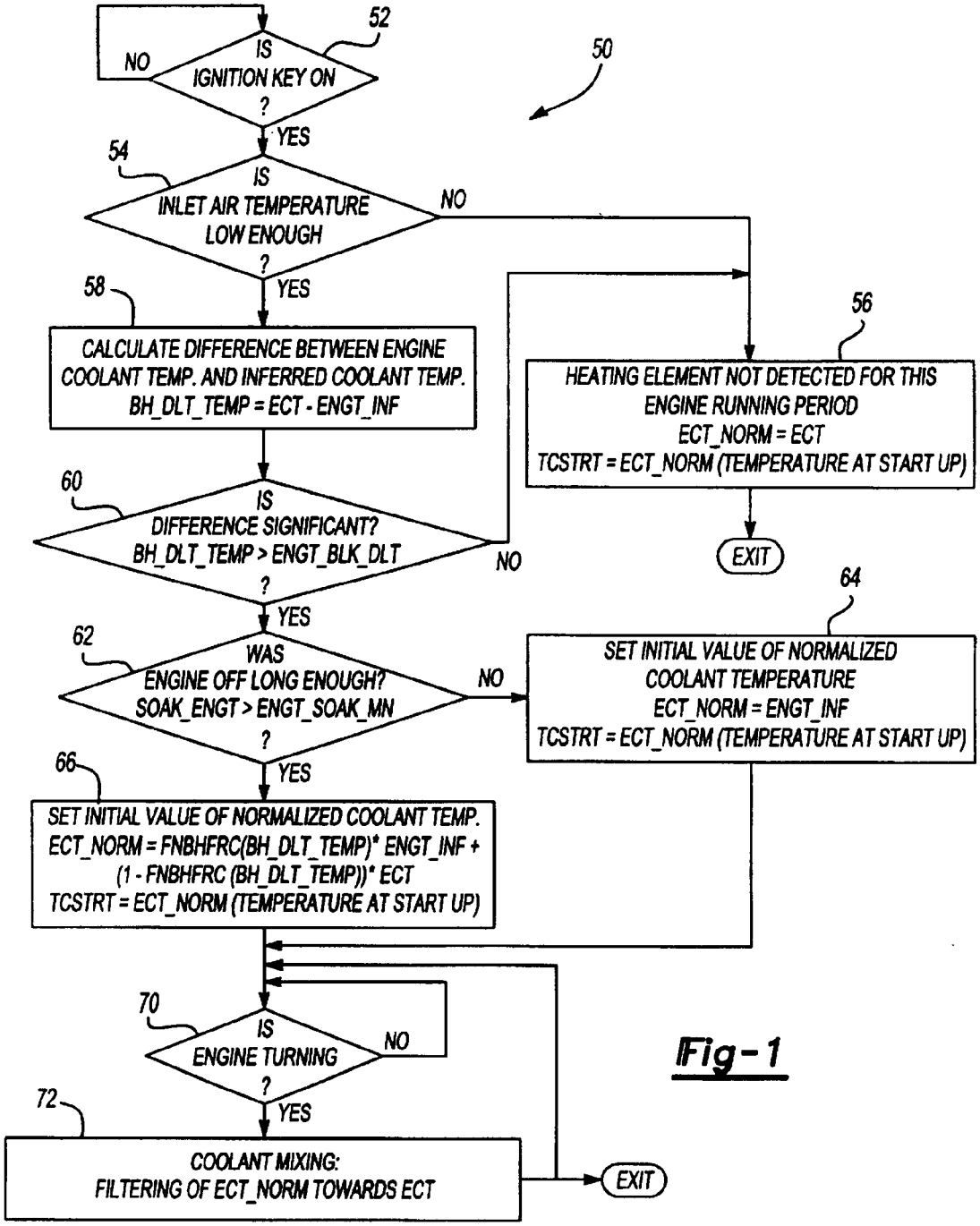
FIG. 1 is a flow diagram showing the steps used in the best mode embodiment of the present invention.

In FIG. 1, the set of method steps are shown in a flow diagram form to illustrate how the use of a block heater is first determined and then how the value of coolant temperature information is compensated prior to it being provided to the associated engine control system.

When the key-on ignition start command is provided in a conventional way, such as by a vehicle operator activating an ignition switch, affirmative output of decision step 52 requires decision step 54 to determine if the inlet air charge temperature (ACT) is below a predetermined threshold level. The ACT is used to represent the ambient air temperature. The threshold level is determined by empirical data as the temperature value below which a block heater is likely to be in use. It is also determined to be low enough that, if a block heater were in use for a long engine-off (soak) period, such use would likely and adversely cause the engine coolant temperature sensor to produce a higher than true temperature reading. As a result, such a high reading would cause the engine control system to provide a leaner air fuel mixture than is sufficient to immediately start the engine and keep it running for the first half minute or less.

If the ACT is determined at step 54 to be below the predetermined threshold level, then such determination indicates that it is likely a block heater is in use. The routine proceeds to step 58 where the difference between the actual reading from the engine coolant temperature sensor (ECT) and an inferred engine temperature (ENGT_INF) is calculated. This difference is then set as the engine block heater temperature delta (BH_DLT_TEMP).

ENGT_INF represents the value the engine coolant temperature is predicted to have been, had no block heater been present. While the engine is off, the engine coolant temperature is expected to cool toward ambient temperature as soak time increases. ENGT_INF is derived from the measured ACT, the difference between the ECT and ACT at the last power-down and the amount of time that elapsed from the previous power-down to the current start command.

The values of ECT and ENGT_INF should be approximately the same unless a block heater is having an effect on the ECT sensor.

At step 60 a determination is made to see if the BH_DLT_TEMP calculated in step 58 is greater than a predetermined value ENGT_BLK_DLT. If the BH_DLT_TEMP is greater than the ENGT_BLK_DLT, the detected use of a block heater is confirmed and compensation for the ECT is required.

Contrarily, if the ACT is determined at step 54 to be not below the predetermined threshold level, there is no detection of the use of a block heater. Also, if the determination made at step 60 is in the negative, indicating that there is no significant difference between the ECT and ENGT_INF, then the effects of having detected the use of a block heater in step 54 are determined to be inconsequential to the engine start procedure and the control system. In each case, the routine proceeds to step 56 where a normalized engine coolant temperature ECT_NORM is set to equal the ECT reading. ECT_NORM is used by the engine control system as the coolant temperature value variable in determining the proper air/fuel mix based on engine temperature. ECT_NORM is the theoretical average temperature of the coolant distributed throughout the engine block, even though some portions of the coolant are in locations remote from the heating effects of the block heater. With ECT_NORM set, the routine exits to the control system strategy.

When the use of a block heater is confirmed at step 60, a determination of soak time is performed at step 62. If the soak time is determined to be greater than a predetermined minimum time (ENG_SOAK_MN), then further calculations are made in step 66. This is because, the ENG_SOAK_MN is set to be the minimum time that an engine can set after power-down without block heater usage having a significant effect on the ECT.

If the soak time for the engine was determined to be greater than the predetermined minimum time ENG_SOAK_MN in step 62, it is necessary to set the initial value of ECT_NORM in step 66. In step 66 the TCSTRT value is set as a blending between the ECT and the ENGT_INF via a block heater function:

FNBHFRC(BH_DLT_TEMP)*ENGT_INF+(1−FNBHFRC(BH_DLT_TEMP))*ECT, where "*" is a multiplication sign.

However, if it is determined in step 62 that the soak time was less than the minimum, this means that the engine had been run through a prior cycle where it was either cranked and shut down or run for a relatively short period of time without eliminating the effects of the block heater usage on the ECT. When it is determined that the soak time in step 62 was less than the minimum, it is assumed that the value of ECT_NORM was set in step 66 in the prior run of the steps in response to the previous start command. Step 64 sets the ECT_NORM equal to the then current ENGT_INF. This ensures that any necessary compensation for the effects of block heater usage is maintained properly during repeated short key-on-off cycling or short engine-running periods. Otherwise, a recalculation of the ECT_NORM using the blending function of step 66 would result in an inaccurate value from which to commence filtering that occurs in step 72. This initial value of normalized coolant temperature ECT_NORM set in step 64 is used by the engine control system as TCSTRT as a substitute for what would otherwise be supplied from step 66.

In step 70 an inquiry is made to determine whether the engine is now turning. "Turning," means whether there is movement in the engine components during the start cycle to cause rotation of the coolant pump and therefore achieve some circulation of the coolant past the ECT sensor. Such circulation will have an effect on the reading of the ECT sensor. If the engine/coolant pump is determined to be stationary, the variable settings are held until a confirmation of engine turning/pump rotation is made.

Once step 70 confirms that the engine is turning and the coolant is circulating, step 72 provides a filtering routine in which the ECT_NORM is blended towards the ECT reading as the routine is cycled. Preferably, a rolling average filter routine is used to provide the ECT NORM value. A time constant BH_ADJ_TC is used in the filter step and after approximately 20 seconds the ECT_NORM is blended to the ECT and the effects of the block heater are no longer relevant to the engine control system.

Alternatively, one filters the difference between the ECT_NORM and the ECT towards a zero value. At the end of each clock cycle that difference is subtracted from ECT to yield an updated value of ECT_NORM.

Although not shown in FIG. 1, whether or not a block heater is detected, the necessary keep alive memory (KAM) parameters used to calculate the ENGT_INF are updated immediately when the engine begins turning. The engine-off soak time SOAK_ENGT is also reset at this time, Theses actions result in more accurate ENGT_INF value after key-on following a very short engine running cycle. (<20 seconds) or a very short engine-off soak time.

Figure 2:
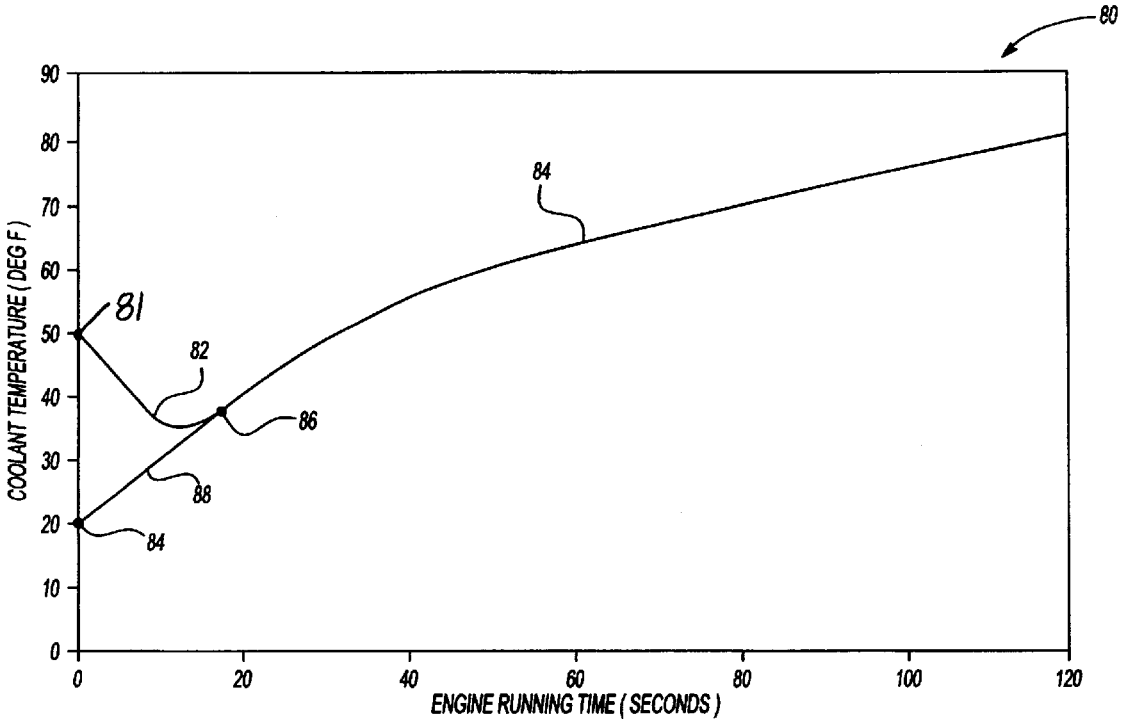
FIG. 2 is a plot of Engine Coolant Temperature vs. Engine Running Time measurements taken to show the effects of an engine block heater on an engine coolant temperature sensor output during the start cycle.

FIG. 2 is a plot 80 of Engine Coolant Temperature versus Engine Running Time in seconds. At time zero seconds, the effect of using an engine block heater is illustrated at point 81 in curve 82, which indicates the ECT sensor reading when a block heater is in use. Also, at time zero point 84 on curve 88 shows the actual average temperature of the engine coolant. Depending on the power characteristics of the heating element used for the engine block heater and the location of the ECT sensor proximate to the heater element, the difference between the ECT sensor reading and the actual average temperature of the engine coolant may vary considerably from one engine configuration to another. Therefore the temperature values shown in plot 80 are merely exemplary of values encountered during development of the invention.

Over the period of approximately the first 20 seconds following the initial start command, curve 82, of FIG. 2, shows how the effects on the ECT are diminished as the coolant is circulated in the engine block with convergence of curves 82 and 88. Therefore, the normalized value of coolant temperature is provided along curve 88. After approximately twenty seconds to one-half minute, the ECT value provides temperature readings that correspond to the average temperature of the coolant at point 86 and along plot curve 87, and the engine control system no longer needs to have compensated ECT values.

While the best mode for carrying out the invention has been described in detail, those familiar with the art to which this invention relates will recognize various alternative designs, embodiments and applications for practicing the invention as defined in the claims.

What is claimed is:

1. A method of determining and compensating for the usage of a block heater in an internal combustion engine which utilizes an engine control system that relies on several variables including engine coolant temperature value, comprising the steps of:

sensing an engine start command;

sensing ambient air temperature;

determining if said air temperature is below a predetermined value;

sensing engine coolant temperature if said air temperature is below said predetermined value;

providing an inferred engine coolant temperature value;

determining if said sensed engine coolant temperature differs from said inferred engine coolant temperature value by at least a predetermined amount;

calculating a normalized value of engine coolant temperature value according to a predetermined function when said sensed engine coolant temperature differs from said inferred engine coolant temperature value by at least a predetermined amount;

providing said normalized engine coolant temperature value to said engine control system as a substitute for the sensed engine coolant temperature value.

2. A method as in claim 1, further including the steps of:

measuring the length of time the engine has been off prior to receiving the engine start command; and calculating said inferred engine coolant temperature value according to a predetermined function which utilizes said sensed ambient air temperature and said measured time as variables.

3. A method as in claim 1, wherein said predetermined function used in said step of calculating a normalized value of engine coolant temperature utilizes said sensed engine coolant temperature value and said inferred engine coolant temperature value variables.

4. A method as in claim 3, further including the steps of determining if said engine is turning and if so, filtering said normalized value of engine coolant temperature with a predetermined time constant towards the sensed engine coolant temperature value.

5. A method as in claim 3, further including the steps of determining if said engine is turning and if so, filtering the difference between said normalized value of engine coolant temperature and said sensed engine coolant temperature value towards zero.

6. A method of detecting and compensating for the usage of a block heater in an internal combustion engine which utilizes an engine control system that relies on several variables including engine coolant temperature value, comprising the steps of:

sensing engine coolant temperature;

providing an inferred engine coolant temperature value;

determining if said sensed engine coolant temperature is higher than said inferred engine coolant temperature value by at least a predetermined amount;

calculating a normalized value of engine coolant temperature value according to a predetermined function when said sensed engine coolant temperature differs from said inferred engine coolant temperature value by at least a predetermined amount;

providing said normalized engine coolant temperature value to said engine control system as a substitute for the sensed engine coolant temperature value.

7. A method as in claim 6, further including the steps of:

sensing ambient air temperature;

measuring the length of time the engine has been off prior to commencing said method; and calculating said inferred engine coolant temperature value according to a predetermined function which utilizes said sensed ambient air temperature and said measured time as variables.

8. A method as in claim 7, wherein said predetermined function used in said step of calculating a normalized value of engine coolant temperature utilizes said sensed engine coolant temperature value and said inferred engine coolant temperature value variables.

9. A method as in claim 8, further including the steps of determining if said engine is turning and if so, filtering said normalized value of engine coolant temperature towards the sensed engine coolant temperature value.

10. A method as in claim 8, further including the steps of determining if said engine is turning and if so, filtering the difference between said normalized value of engine coolant temperature and said sensed engine coolant temperature value towards zero.

11. A method of compensating for the effects of using a block heater in an internal combustion engine comprising the steps of:

providing an engine control system that relies on several variables including engine coolant temperature value;

sensing an engine start command;

sensing ambient air temperature;

comparing said sensed air temperature value with a predetermined low temperature value;

sensing engine coolant temperature when said sensed air temperature value is below said predetermined value;

providing an inferred engine coolant temperature value;

comparing said sensed engine coolant temperature with said inferred engine coolant temperature to determine if said sensed engine coolant temperature is greater than said inferred engine coolant temperature value by at least a predetermined amount;

calculating a normalized value of engine coolant temperature value according to a predetermined function when said sensed engine coolant temperature differs from said inferred engine coolant temperature value by at least a predetermined amount;

providing said normalized engine coolant temperature value to said engine control system.

12. A method as in claim 11, wherein said step of calculating includes the steps of calculating an initial value of normalized value of coolant temperature and subsequently calculating values of normalized coolant temperature using a predetermined filter function.

13. A method as in claim 11, wherein said step of sensing ambient air temperature, includes the sensing of engine inlet air temperature.

14. A method of compensating for the effects of using a block heater in an internal combustion engine comprising the steps of:

providing an engine control system that relies on several variables including engine coolant temperature value;

sensing an engine start command;

sensing engine coolant temperature;

providing an inferred engine coolant temperature value;

comparing said sensed engine coolant temperature with said inferred engine coolant temperature to determine if said sensed engine coolant temperature is greater than said inferred engine coolant temperature value by at least a predetermined amount;

calculating a normalized value of engine coolant temperature value according to a predetermined function when said sensed engine coolant temperature is greater than said inferred engine coolant temperature value by at least a predetermined amount;

providing said normalized engine coolant temperature value to said engine control system.

15. A method as in claim 14, wherein said step of calculating includes the steps of calculating an initial value of normalized value of coolant temperature and subsequently calculating values of normalized coolant temperature using a predetermined filter function.

16. A method for determining an engine coolant temperature value of an internal combustion engine in response to an engine start command, comprising:

sensing an engine coolant temperature;

providing an inferred engine coolant temperature;

calculating a normalized value of engine coolant temperature according to a predetermined function; and basing said engine coolant temperature value on said normalized engine coolant temperature when said inferred engine coolant temperature differs from said sensed engine coolant temperature by more than a predetermined amount.

17. The method of claim 16, further comprising basing said engine coolant temperature value on said sensed engine coolant temperature when said inferred engine coolant temperature differs from said sensed engine coolant temperature by less than said predetermined amount.

* * * * *